US011147356B2

(12) United States Patent
Poletto

(10) Patent No.: US 11,147,356 B2
(45) Date of Patent: Oct. 19, 2021

(54) BRUSH FOR COSMETIC PRODUCTS

(71) Applicant: BRIVAPLAST S.r.l., Milan (IT)

(72) Inventor: Anna Poletto, Milan (IT)

(73) Assignee: BRIVAPLAST S.R.L., Milan (IT)

( * ) Notice: Subject to any disclaimer, the term of this patent is extended or adjusted under 35 U.S.C. 154(b) by 203 days.

(21) Appl. No.: 16/227,667

(22) Filed: Dec. 20, 2018

(65) Prior Publication Data

US 2019/0200729 A1 Jul. 4, 2019

(30) Foreign Application Priority Data

Jan. 3, 2018 (IT) ..... 102018000000533

(51) Int. Cl.
*A45D 40/26* (2006.01)
*A46B 9/02* (2006.01)
*A46D 1/00* (2006.01)

(52) U.S. Cl.
CPC ..... *A45D 40/262* (2013.01); *A46B 9/021* (2013.01); *A46B 9/026* (2013.01); *A46D 1/0238* (2013.01); *A46D 1/0284* (2013.01); *A46B 2200/1053* (2013.01)

(58) Field of Classification Search
CPC .. A45D 40/262; A45D 40/264; A45D 40/265; A45D 40/267; A45D 40/268; A46D 1/0238; A46D 1/0284; A46D 1/0246; A46D 1/0276; A46D 9/021; A46D 9/026; A46D 9/023; A46D 9/025; A46D 9/028; A46D 2200/1053
See application file for complete search history.

(56) References Cited

U.S. PATENT DOCUMENTS 4,974,612 A * 12/1990 Gueret ..... A45D 40/267 132/218
9,427,075 B2 * 8/2016 Gueret ..... A46B 9/021
10,278,478 B2 * 5/2019 Sanchez ..... A46B 9/021
2003/0150077 A1 * 8/2003 Montoli ..... A46B 9/021 15/206
2004/0240926 A1 * 12/2004 Gueret ..... A46B 3/18 401/122
2006/0056903 A1 * 3/2006 Gueret ..... A45D 40/267 401/129
2008/0184512 A1 * 8/2008 Gueret ..... A45D 40/265 15/206

(Continued)

FOREIGN PATENT DOCUMENTS

EP 2064969 A2 6/2009
WO 2017198614 A1 11/2017

OTHER PUBLICATIONS

Italian Search Report for corresponding Italian Patent Application No. 102018000000533 dated Aug. 23, 2018.

*Primary Examiner* — Nicholas D Lucchesi
(74) *Attorney, Agent, or Firm* — Pearne & Gordon LLP

(57) ABSTRACT

Brush for cosmetic products made of plastic material of the type apt to engage with an applicator rod including a central core having a substantially cylindrical shape carrying at the end a dome-shaped radiussed appendix and of the combination of various series of teeth mutually equidistant in a longitudinal direction, characterised in that the teeth have a grain-shaped section, which furthermore has two opposite edge lines in correspondence of the extreme points of the major axis.

11 Claims, 4 Drawing Sheets

(56) References Cited

U.S. PATENT DOCUMENTS

| | | | | |
|---|---|---|---|---|
| 2009/0083925 | A1* | 4/2009 | Mathiez | A46B 9/028 15/207.2 |
| 2010/0192968 | A1* | 8/2010 | Gueret | A45D 40/265 132/200 |
| 2015/0020332 | A1* | 1/2015 | Jacob | B29C 45/2626 15/160 |
| 2015/0024080 | A1* | 1/2015 | Jacob | B29C 45/2626 425/542 |
| 2015/0216286 | A1* | 8/2015 | Wolfsgruber | A45D 40/267 401/122 |

* cited by examiner

BRUSH FOR COSMETIC PRODUCTS

FIELD OF THE INVENTION

The present invention relates to the field of brushes, in particular of brushes for cosmetic use made of plastic material, comprising a portion of brush composed of a base body and a series of teeth, which replace the bristles of the similar brushes in natural or textile fibres extending therefrom.

BACKGROUND OF THE INVENTION

Brushes made by injection moulding have long been known in the art, in which it is envisaged the use of a deformable thermoplastic material, such as polyethylene, making the teeth flexible, in order to offer the user a more pleasant perception of the arrangement of the product.

Although several efforts were made in the selection of the material to be used during the moulding phase, in brushes made in this way the engagement of the teeth with the eyelashes still tends not to be easy, and consequently the user perceives an unpleasant sensation of tearing.

Specifically, it has been found that conventional plastic hair, even with appropriately selected or specially created materials, produces an unpleasant scraping effect, when a cosmetic product is applied to the eyelashes or to the hair.

BRIEF SUMMARY OF THE INVENTION

It is therefore an object of the present invention to provide a brush made of a plastic material which is able to make the perception of the user even more pleasing when applying the cosmetic product.

It is also an object of the invention to create a universal object having high performance, i.e. guaranteeing the maximum separation capacity of eyelashes for a brush for cosmetic products, such as mascara or hair care products, and increasing performance, with a reduction in the consumption and application times.

This object is obtained by means of a brush for cosmetic products made of plastic material of the type apt to engage with an applicator rod consisting of a central core having a substantially cylindrical shape carrying at the end a dome-shaped radiussed appendix and of the combination of various series of teeth mutually equidistant in a longitudinal direction, characterised in that said teeth have a grain-shaped section, which furthermore has two opposite edge lines in correspondence of the extreme points of the major axis.

BRIEF DESCRIPTION OF THE DRAWINGS

The brush will be now described with reference to the figures intended to illustrate the preferred solutions, which shall however be considered as exemplary, and not reductive, of the inventive scope of the invention, wherein.

DESCRIPTION OF EXAMPLE EMBODIMENTS

Figure 1:
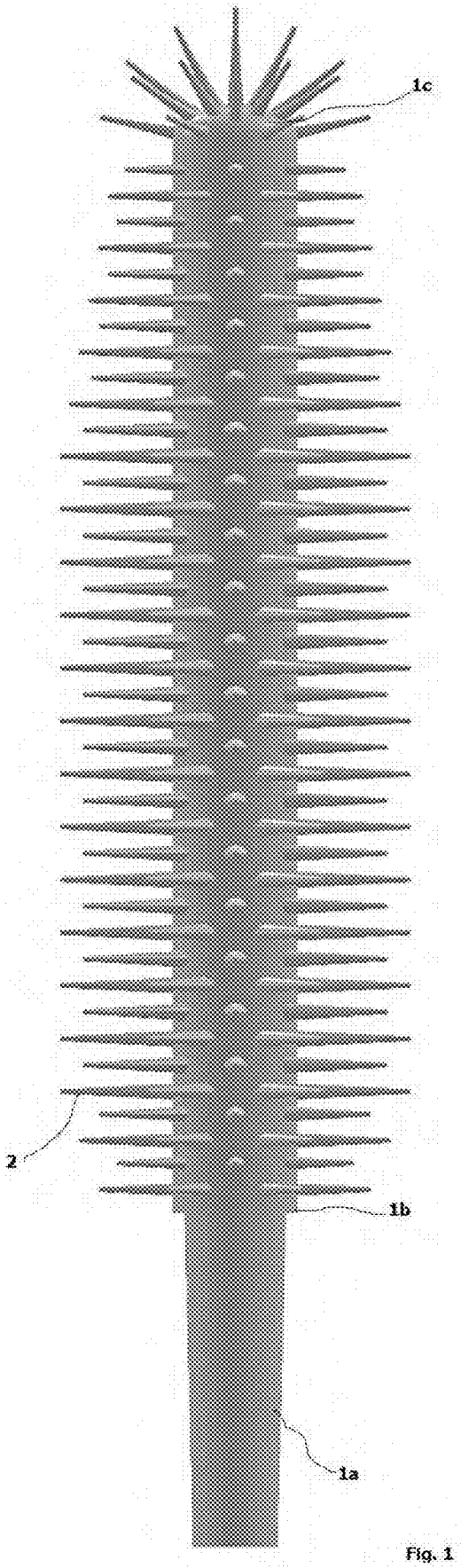
FIG. 1 is a front view of a preferred embodiment of the brush according to the invention.
Figure 2:
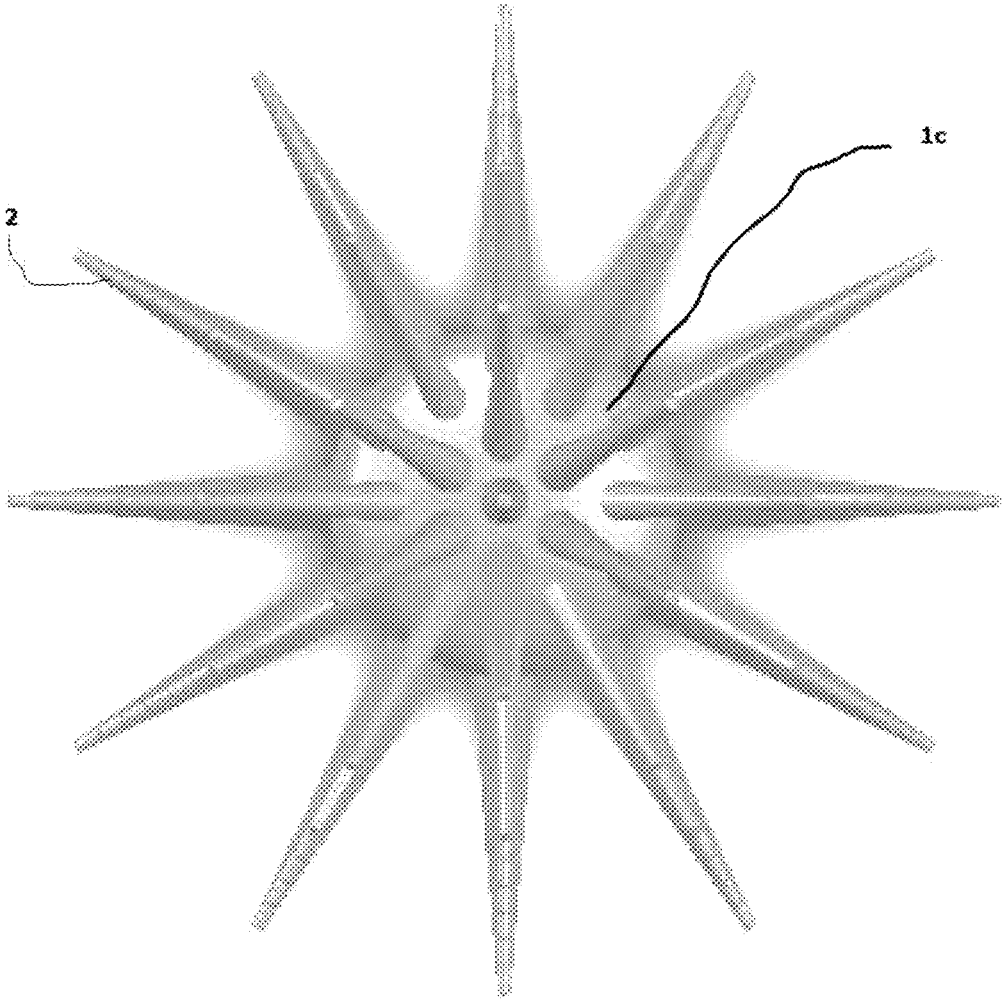
FIG. 2 is a top view of a preferred embodiment of the brush according to the invention.
Figure 3:
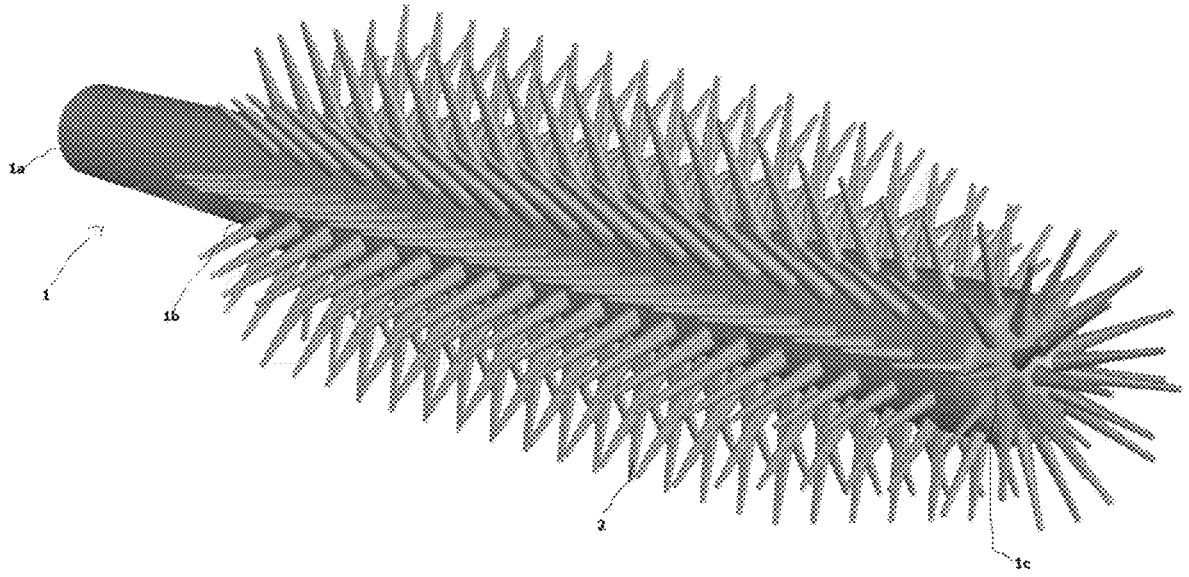
FIG. 3 is a perspective view of a preferred embodiment of the invention.
Figure 4:
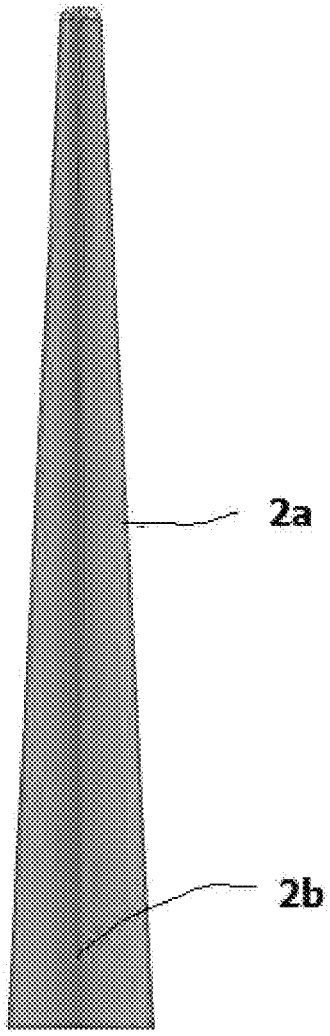
FIG. 4 is the side view of a tooth of the brush of FIG. 1.
Figure 5:
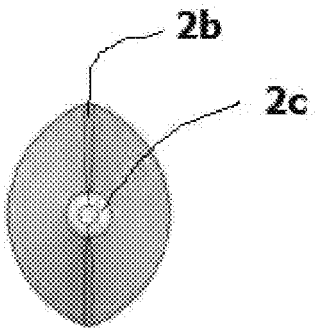
FIG. 5 is a top view of the tooth of FIG. 4.

The brush according to the invention is composed of a central core 1 having a substantially cylindrical shape, wherein an engagement zone 1*a* with a rod (not shown) of an applicator body, having a smaller diameter, to guarantee the correct engagement of the brush body to the stem itself, a central zone 1*b* of the properly said brush and a top surface 1*c*, consisting of a radiussed dome are present.

The entire area above said engagement zone 1*a* with a rod is covered by several series of teeth 2.

In correspondence of the central zone 1*b*, the aforesaid teeth are equidistant, both longitudinally and latitudinally, to form a matrix of teeth 2 with a defined and ordered geometry. Likewise, in correspondence of the dome 1*c*, they are arranged according to a radiussed symmetry to identify the directions protruding from the beams.

Each tooth 2 consists of a conical element, having a grain-shaped section, which also has two opposed edge lines in correspondence of the end points of the major axis.

In particular, the tooth 2 is composed of two identical portions 2*a* coupled, even if they do not arise from the base of a known regular figure, each having identical arch of radius and width. Between the extremities of each arch there is also a chord which is greater than the maximum distance perpendicular to the chord, which can be identified between two opposite points on the two arches.

In this way, a particular geometry is created, wherein two substantially flat lateral ridges 2*b* with respect to the coupling axis are evident, to form an invitation surface for the correct insertion of the aforesaid tooth 2 between two eyelashes.

In order that the tooth 2 of the brush according to the invention can obtain even more reliable performances, it is preferred for the upper surface 2*c* of said tooth 2 to be radiussed.

Furthermore, it is advisable that the vertical axis of the teeth 2 composing each of said series of teeth have a perpendicular conformation with respect to the cylindrical surface of the core 1 and that the subtended chord between the intersection points of the arches is oriented perpendicularly to the longitudinal axis of the core.

Finally, it has been found that—in order to optimize the collection and homogeneous and rapid application of the cosmetic product—it is necessary that the ratio between the diameter of said applicator rod and the diameter of said central core is between 1 and 3, and more preferably between 1.3 and 2.3.

From a morphological point of view, it is also necessary to highlight the fact that—in order to obtain a longer stroke for the brush—and thus to ensure a perfect coverage of the edge in a single pass—the applicant has tended to force the limit, creating a mould with twelve flower-shaped sectors.

Then, it has been created a tooth structure which identifies a bidirectional slant, recognizable in all the possible movement directions of the applicator, which allows a single applicator to guarantee correct movement both for left-handed and for right-handed users: therefore, it is not necessary to prepare suitable applicators.

In operation, the user operates in a conventional manner, however, having teeth which are inserted precisely between two eyelashes at the moment in which the applicator approaches the eye. The tooth—appropriately shaped in the manner now disclosed—cleaves the two flaked lashes, separating them. Subsequently—with the rotation of the applicator—it will expand the distances on the one hand and it will deposit the cosmetic substance on the other. In this way, the user is required to use a single pass to ensure the correct and complete deposition, quickly and with considerable savings in terms of used material. The head with the teeth in a radiussed arrangement allow them to reach the innermost points of the eye.

Therefore, it has been possible to observe that the morphology allows the eyelashes to slide into the mascara reservoir, making the passage more slippery and comfortable than it is today.

In this way, a universal brush has also been obtained, since the choice of the dimensional ratios, and in particular of the length of the tooth, allows to obtain that the proportions between free and penetrable volume in the brush are relating to the density of the eyelashes along the eyelid, the density of eyelashes not being a factor any longer.

We now want to highlight the fact that the alignment of the teeth along the central core can be widely subject to modifications, without departing from the scope of the invention, as defined by the attached claims.

The invention claimed is:

1. A brush for cosmetic products made of plastic material and configured to engage with an applicator rod, the brush comprising:

a central core having a substantially cylindrical shape and a dome-shaped radiused appendix at an end of the substantially cylindrical shape; and one or more series of teeth mutually equidistant in a longitudinal direction, wherein each tooth has:

a cross-section shape having two arcs intersecting with each other at a first end point and a second end point, a first edge line extending longitudinally along the tooth and corresponding to the first end point of the cross-section shape, and a second edge line extending longitudinally along the tooth and corresponding to the second end point of the cross-section shape.

2. The brush for cosmetic products according to claim 1, wherein the two arcs have identical radius and width, and a chord subtended between the first end point and second end point is always longer than a maximum distance perpendicular to said chord detectable between two opposite points on the two arcs.

3. The brush for cosmetic products according to claim 1, wherein said one or more series of teeth vary overall from 1 to 12.

4. The brush for cosmetic products, according to claim 3, wherein said one or more series of teeth are arranged perfectly aligned.

5. The brush for cosmetic products according to claim 3, wherein said one or more series of teeth are arranged in a mutually offset position in a vertical direction.

6. The brush for cosmetic products according to claim 1, wherein a vertical axis of each tooth is normal to a cylindrical surface of the central core.

7. The brush for cosmetic products according to claim 1, wherein a chord between the first end point and the second end point is oriented perpendicularly to a longitudinal axis of the central core.

8. The brush for cosmetic products according to claim 1, wherein an upper surface of each tooth is radiused.

9. The brush for cosmetic products according to claim 1, further comprising a series of teeth in a radial pattern on said dome-shaped radiused appendix.

10. The brush for cosmetic products according to claim 1, further comprising said applicator rod, wherein a ratio between diameters of said applicator rod and said central core ranges between 1 and 3.

11. The brush for cosmetic products according to claim 10, wherein the ratio between diameters of said applicator rod and said central core ranges between 1.3 and 2.3.

* * * * *